United States Patent [19]

Wyckhuys

[11] 4,157,792

[45] Jun. 12, 1979

[54] TRANSPORT MECHANISM FOR CHANGING BOBBINS IN A WINDING-UP APPARATUS FOR WIRE

[75] Inventor: Jozef Wyckhuys, Meulebeke, Belgium

[73] Assignee: N. V. Bekaert S.A., Zwevegem, Belgium

[21] Appl. No.: 808,172

[22] Filed: Jun. 20, 1977

[30] Foreign Application Priority Data

Jun. 21, 1976 [GB] United Kingdom ..... 25722/76

[51] Int. Cl.[2] ..... B65H 54/02; B65H 67/04

[52] U.S. Cl. ..... 242/25 A; 242/35.5 A; 242/46.4; 242/79

[58] Field of Search ..... 242/25 A, 25 R, 18 A, 242/18 R, 18 EW, 18 PW, 35.5 A, 78, 79

[56] References Cited

U.S. PATENT DOCUMENTS

| | | | |
|---|---|---|---|
| 2,341,369 | 2/1944 | Fornwald, Jr. | 242/25 R |
| 2,905,402 | 9/1959 | Foller et al. | 242/18 A |
| 3,592,399 | 7/1971 | Woodrow | 242/25 R |
| 3,620,482 | 11/1971 | Bravin | 242/25 A |
| 3,625,448 | 12/1971 | Griffiths | 242/25 R X |
| 3,791,126 | 2/1974 | Kose et al. | 242/18 A UX |
| 3,845,913 | 11/1974 | Hagen | 242/25 R |
| 3,918,650 | 11/1975 | Kemel | 242/25 R |
| 3,964,723 | 6/1976 | Schippers et al. | 242/18 A X |
| 4,007,882 | 2/1977 | Isoard | 242/18 R |

FOREIGN PATENT DOCUMENTS

| | | | |
|---|---|---|---|
| 1270915 | 6/1968 | Fed. Rep. of Germany | 242/25 A |

*Primary Examiner*—Stanley N. Gilreath
*Attorney, Agent, or Firm*—Shlesinger, Arkwright, Garvey & Dinsmore

[57] ABSTRACT

A winding apparatus for winding wire onto bobbins including a support member for first and second bobbins and means for rotating the support about an axis parallel to that of the bobbin for moving the bobbins into alignment with the bobbin shaft, and means for laterally moving the bobbins from the carrier onto the bobbin shaft as well as from the shaft onto the carrier, so that a full bobbin may be removed from the bobbin shaft, the carrier member rotated so as to bring an empty bobbin into alignment with the bobbin shaft and then for moving the empty bobbin onto the bobbin shaft so that it may be wound with wire.

9 Claims, 18 Drawing Figures

TRANSPORT MECHANISM FOR CHANGING BOBBINS IN A WINDING-UP APPARATUS FOR WIRE

The present invention relates to winding apparatus and is particularly concerned with bobbin transport means for winding apparatus of the type including a shaft arranged for extending through the core of a hollow-cored bobbin, rotatably mounted at one end of the shaft, and arranged for reception and removal of said bobbin, via the other end by translation in axial direction.

It is often desirable with a winding apparatus that it should be able, when a bobbin mounted thereon is fully wound, to execute a bobbin replacement without human intervention. This permits an operator to watch a great number of machines without having to be present at those machines which are running out. Thus bobbin replacement means may be provided, in which bobbin replacement is carried out by electrical, hydraulic or mechanical means, without any human force. Such means can then easily be controlled from a push-button control panel or, if human intervention is desired to be completely eliminated, by a control system which sends the necessary start and stop signals to the driving means of the system.

The movements required for transport of bobbins in winding apparatus of the type described above are, however, rather complicated. The full bobbin must be slipped off the shaft in an axial direction to make room for a new bobbin, and enter into a stand-by position whence the operator can take away the bobbin at his convenience. The new empty bobbin must come from a stand-by position where the operator has put it, and then be aligned with the shaft, and finally be slipped on the shaft. Apart from the necessity to cut the wire from the full bobbin to fix it on the new empty one, the transport of the bobbins does itself present a serious problem, when it is desired to have a mechanism which is practical.

According to the present invention there is provided a winding apparatus comprising:

(a) a carrier support member having first and second bobbin carriers mounted thereon, the carrier support member being rotatable about an axis parallel to that of the bobbin shaft between first and second coincidence positions in which bobbins mounted on the first and second bobbin carriers respectively can be located coaxially with the bobbin shaft, the bobbin carriers being rotatably mounted on the carrier support member for rotation about axes parallel to, but offset from both the axis of the carrier support member and the core of a respective bobbin when mounted thereon;

(b) a positioning member, pivotable around an axis parallel to that of the bobbin shaft, and linked by a transmission system to said bobbin carriers in order to have the latter to follow the angular position thereof, whereby pivoting the positioning member causes pivoting of each bobbin carrier between an upper position for locating a bobbin carried thereon coaxially with the bobbin shaft, and a lower position;

(c) and a translation mechanism for axial movement of the bobbin shaft whereby a bobbin mounted on a carrier in its coincidence and upper position may be moved axially from a position in which the bobbin core is substantially traversed by said shaft, and a position in which the bobbin core is empty.

Preferably, said translation mechanism is connected to the carrier support member for translation of the support member with the bobbin carriers mounted thereon.

The apparatus mechanism may be used in the following way. Starting from the moment when the rotation of the bobbin is stopped, the bobbin carriers are pivoted upwards in such a way that the carrier under the full bobbin on the shaft is lifted a few centimeters in order to give support to the bobbin: the other carrier, which carries an empty bobbin, will also be lifted, although this is not necessary. Then the translation mechanism is actuated, so that the full bobbin which is carried by its carrier is slipped off the shaft, whilst the empty bobbin on its respective carrier follows the same axial translation over the same distance. Then the support member is rotated from its first to its second coincidence-position, so that the full bobbin leaves its position coaxial with the shaft, whilst the empty bobbin comes into that coaxial position.

During that movement, the positioning member keeps the same angular position in such a way that, due to the transmission system, the bobbin carriers keep the same angular position and so, the movement of each bobbin is in fact a non-rectilinear translation over an arc of a circle, without rotation of the carriers themselves. It is thus possible, as is preferred, to use as a bobbin carrier a substantialy horizontal table, of which the surface is so shaped as to keep the bobbin, standing on circular flanges, in stable equilibrium on the table in both upper and lower position and during transition from the one to the other. Subsequently, the translation mechanism is moved back towards its initial axial position, and so the empty bobbin is slipped on the shaft whilst the full bobbin follows the same axial translation over the same distance. The carriers are then pivoted downwards in such a way that the carrier under the empty bobbin on the shaft ceases to support that bobbin and that the shaft takes over the supporting function. At the same time the carrier which carries the full bobbin brings this bobbin a few centimetres downwards, preferably to ground level.

Preferably, the axes of rotation of the bobbin carriers are symmetrically disposed on the carrier support member, whereby movement of the support member from its first to its second coincidence position, and further from its second into its first coincidence position, is achieved by a 180° rotation of the support member, and further by another 180° rotation in the same sense.

When a driving mechanism is used where a bobbin is mounted on a driving shaft, conventional means can be used to couple the bobbin to the shaft in order that the bobbin follows the rotation of the shaft. This can be done by any conventional means, such as for instance by a driving disc, perpendicular to, concentric with and mounted on the shaft, for engaging the central part of the external surface of one of the flanges, by its surface irregularity design, or by other means. It may also be by the design of the cross-section of the shaft and the hollow core, so that they engage with each other. It is however preferred to use a shaft with axially extending keys which are movable radially of the shaft to engage the inside of the hollow cylindrical core of a bobbin over substantially its entire length. The driving shaft, if necessary, may be supported at both ends during its rotation, in the manner explained in the British Pat. No. 1,440,239. To that end the apparatus preferably comprises a centre, movable between an operative position in which it engages under axial pressure the free other end of the bobbin shaft, and a retracted position to enable a bobbin to be received on and removed from the shaft. Most preferably this centre will be mounted in a door which in the operative position of the centre, closes a housing for the bobbin on said shaft, and in the retracted position of the centre, is open to enable a bobbin to be introduced into and removed from the said housing.

Preferably, the axis of pivoting of the positioning member of the bobbin carriers on the carrier support member is made coaxial with the axis of rotation of this member. The said transmission system, which makes the bobbin carriers to follow the angular position to said positioning member, independently from any rotation of the carrier support member, can then be made in the form of a planetary system in the form of a belt or a chain system or, as is preferred, using a number of toothed wheels as is well known in the art. In that case also, it is preferred to mount the carrier support member on a tubular support shaft for rotation therewith, and the positioning member is a further shaft located and non-translatably mounted within the support shaft and the translation mechanism comprises a threaded shaft in engagement with a complementary threaded bore in said further shaft.

Thus, when the threaded shaft, which is only retractable around its axis, it rotated in one or in the other sense, the whole assembly will translate, in the axial direction of the threaded shaft, in one or in the other direction.

In some applications, the winding apparatus may be fed by a wire production apparatus and one made to follow the speed of the other by the use of a suitable control system. When the winding apparatus is stopped, the wire production apparatus is also stopped and does no longer feed any wire via the guiding means towards the full bobbin. This may have the result that the full bobbin cannot freely be removed, because there is still the wire end going from the wire production apparatus to the full bobbin, which may be too short to allow free movement of the full bobbin. In that case, it is preferred to use a wire buffer-accumulator between the output of the wire production apparatus and the wire guiding mechanism, which keeps a reserve of wire which can be drawn out of this accumulator if necessary. This buffer-accumulator is in general the same one which is adapted to deliver an input-signal to the control system for adapting the speed of the production apparatus and the winding-up apparatus to each other. Such buffer accumulator can be formed by a pulley-system, where the pulleys are movable with respect to each other in order to lengthen or shorten the wire path through the pulley system, and which are linked to each other by a spring system which extends to lengthen the wire-path as in U.S. Pat. No. 4,004,744.

One embodiment of the invention will now be described, by way of example only, with reference to the accompanying drawings in which.

Figure 1:
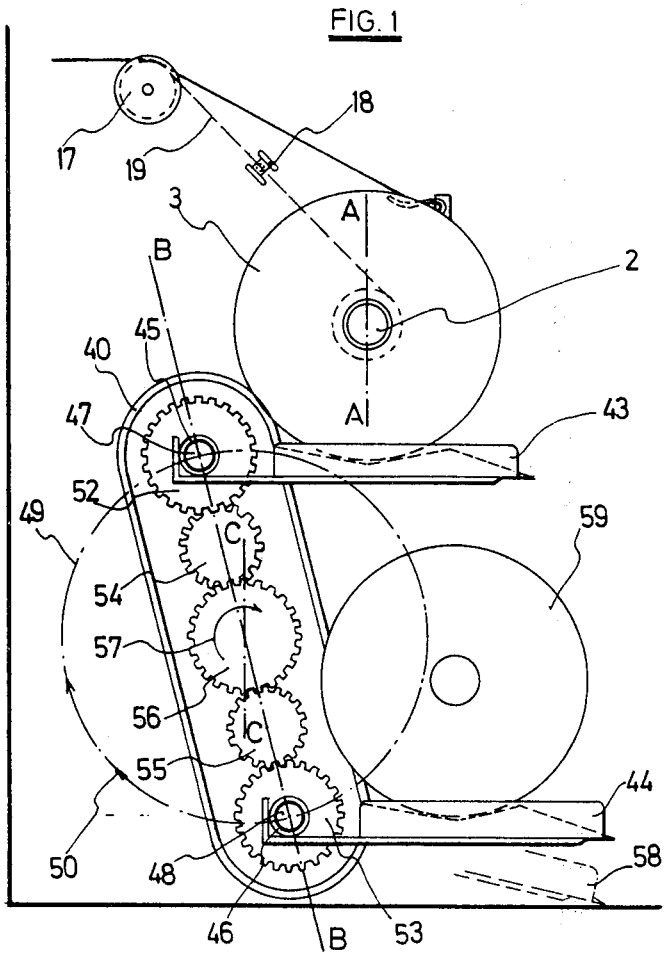
FIG. 1 is a side-elevation of a wire-winding apparatus according to the invention.
Figure 2A:
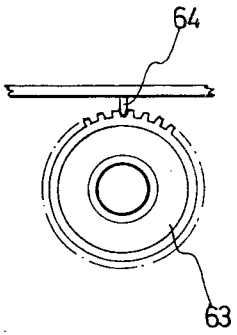
FIG. 2 is a cross-sectional view of the apparatus of FIG. 1, taken partly along line AA, partly line BB, and partly line CC of FIG. 1.
Figure 2:
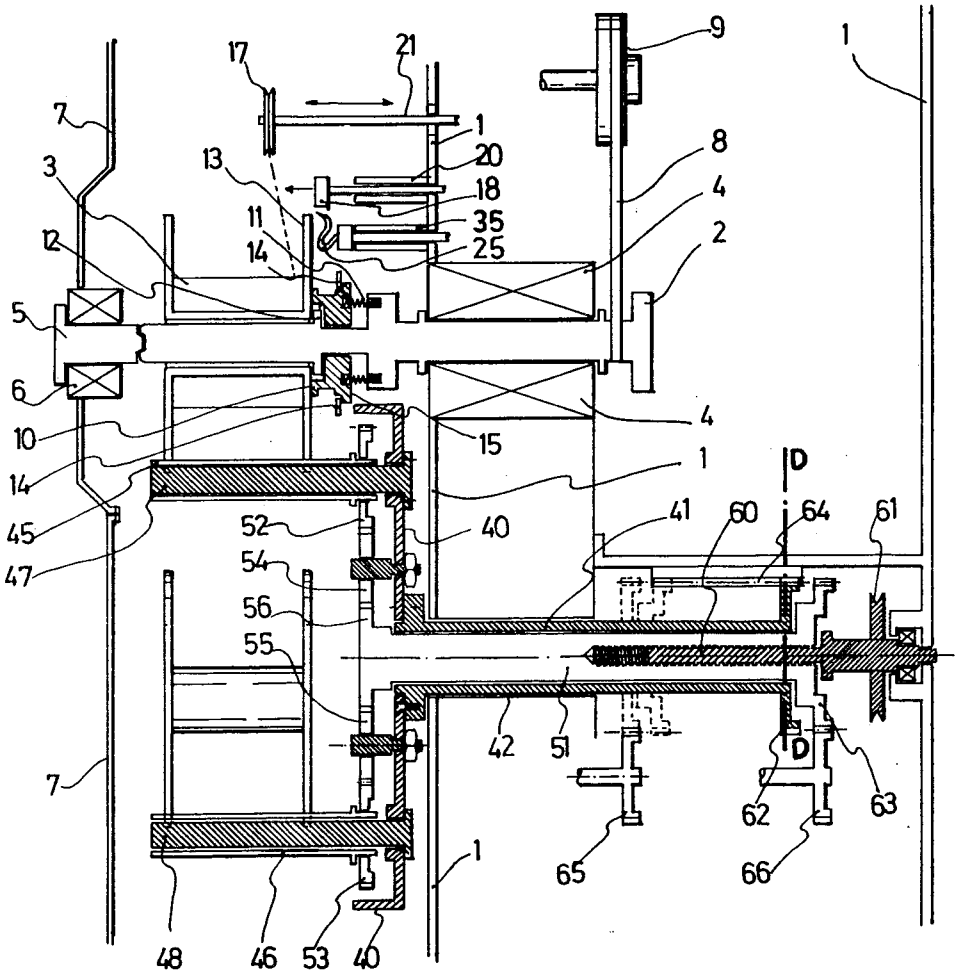
Figure 4:
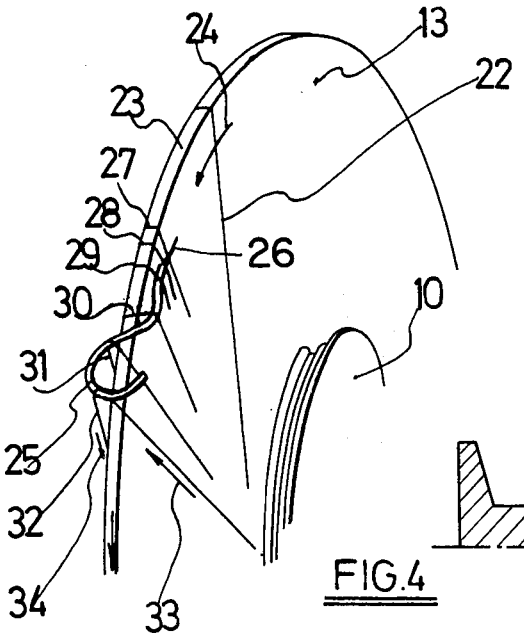
Figure 5:
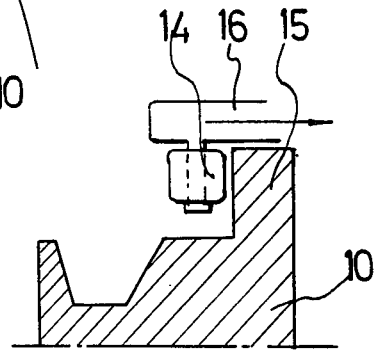

FIG. 2*a* is a cross-sectional view on line D—D of FIG. 2;

FIG. 3*a*1 to *j* shows schematically the sequence of movements executed by the apparatus during change of bobbins;

FIG. 4 is a detail view showing operation of the wire-guiding finger of the apparatus; and FIG. 5 shows a detail view of the system used for putting the clamping system in a position to release the wire.

Figure 6:
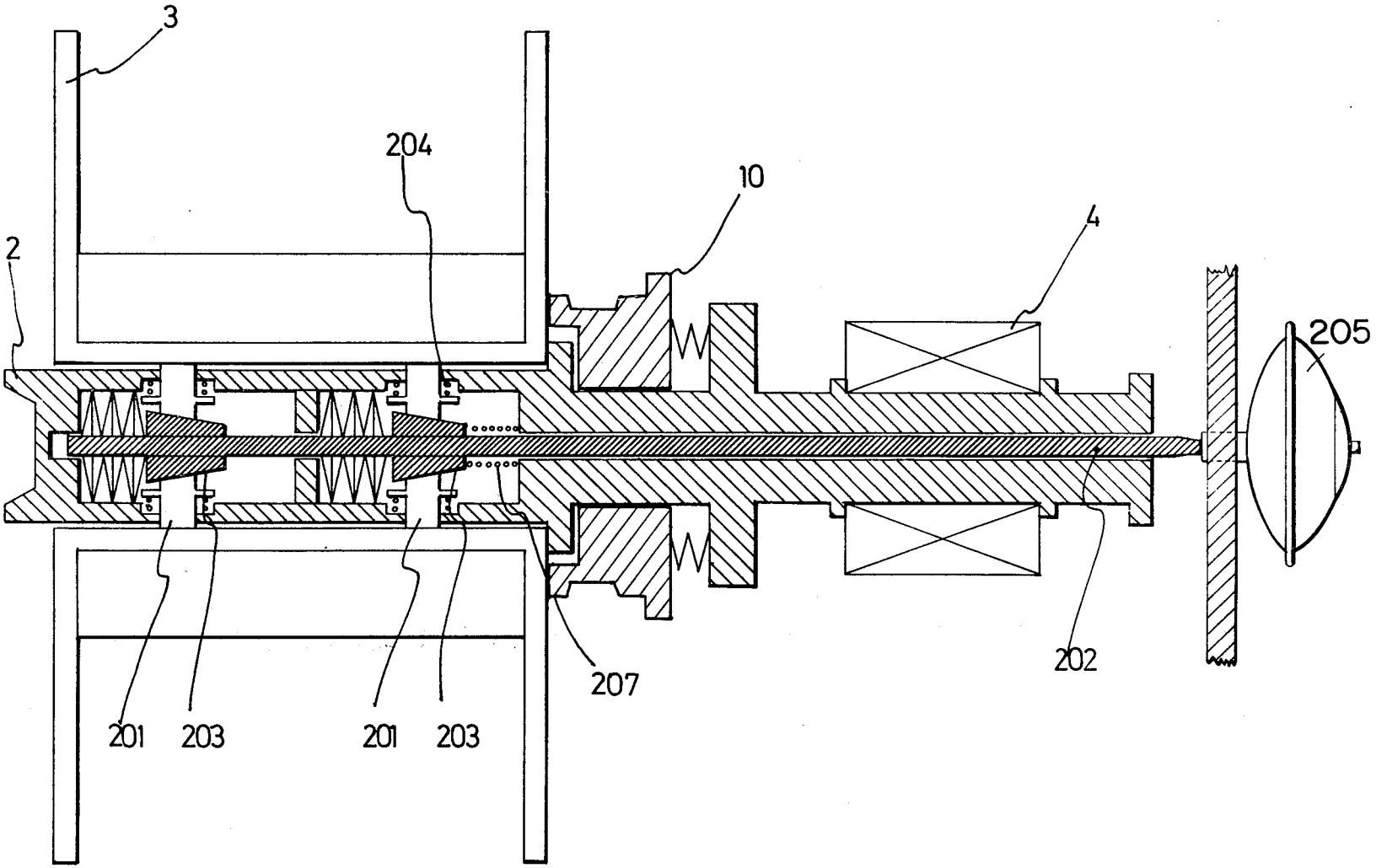

FIG. 6 is a cross-sectional view showing the bobbin and the clamping keys used therewith.

Referring now to FIGS. 1 and 2, the apparatus comprises a fixed frame 1 in which is mounted a horizontal cantilever-mounted shaft 2 as support means for a flanged bobbin 3, which is shown in its working position for rotation.

The right-hand end of the shaft (FIG. 2) is rotatably, but not axially translatably, held in a bearing 4, which is sufficient to support the shaft with a full bobbin mounted on it, the hollow core of the bobbin being traversed by the shaft. In order to provide additional support to the shaft during its rotation, the left-hand end of the shaft engages in a centre 5, which is mounted in a door 7 of the apparatus by means of a bearing 6. The door 7, which is shown in cross-section in FIG. 2, is pivotable around a vertical axis, outside the plane of the drawing, perpendicular to the shaft axis and parallel with the plane of the drawing. This door forms part of a protective housing around the apparatus and is not shown in FIG. 1, which only shows what is visible behind that door. When the door is opened, the centre 5 disengages from the left-hand end of the shaft, and pivots away to make room for carrying out the operation of bobbin replacement as will be explained later. The door is further provided with a bolt system, not shown, and with hydraulic means to bolt and unbolt the door, and opening and closing it without using human force. These hydraulic means are further connected to a control panel, where the operations are controlled with the help of push-buttons and, if necessary, by a completely automatic control system adapted to command the sequence of operations.

The bobbin 3 is fixed to the shaft in such a way to rotate with the shaft. To that end, the shaft is provided around its circumference with a number of keys 201 (FIG. 6) which are radially movable in and out of the shaft. When pushed outwardly of the shaft, these keys are pressed against the inner surface of the hollow core of the bobbin for engaging this surface. For moving the keys, the shaft is provided with an axially movable central rod 202 on which are fixed a number of conical members 203 in frictional engagement with the keys. When the rod 202 is moved to the right as seen in FIG. 7, the conical bodies urge the keys 201 outwardly, and when the rod 202 is moved to the left, the conical bodies are no longer forced outwardly and move inwardly under the action of springs 204. The rod 202 is pushed to the right by means of disc springs 206, and is urged to the left by spring 207 and pressure diaphragm 205. When the pressure diaphragm 205 is depressurized, the rod 202 is kept to the right and the keys 201 are pressed against the inner surface of the bobbin 3. When the pressure diaphragm is put under pressure, the rod is urged to the left whereby the keys move inwardly. In order to have maximum holding effect, the keys would extend axially over substantially the entire distance of the bobbin 3 from one flange to the other.

On the shaft is mounted a disk, which is co-axially mounted on the shaft and surrounds the shaft, as is shown in cross-section, along line A—A of FIG. 1, on FIG. 2. This disk 10 is connected to the shaft by a number of springs 11 which urge the disk in an axial direction so that its side surface abuts an annular raised portion 12 of the shaft 2 and presses against the adjacent flange 13 of the bobbin 3, in its working position for rotation as shown. As the disk 10 is connected to the shaft by the springs, it is constrained to rotate with the shaft. The disk can be retracted from the flange 13, against the force of the springs 11, i.e. to the right as shown in FIG. 2, by means of a pair of rollers 14, symmetrically disposed around the disk. Each of these rollers is mounted on an arm 16 (FIG. 5) which is supported by the fixed frame 1, but movable to the right by driving means, not shown, which can be electromagnetic or hydraulic and commanded by a control unit forming part of the same control panel mentioned above. When arm 16 moved to the right, the rollers 14 are made to engage an annular protrusion 15 of the disk 10 and to roll on it whilst it rotates, and push the disk to the right. Subsequently, when the arm is moved back to the left, the disk, under influence of the springs 11, moves to the left until it abuts again the annular portion 12 of the shaft and presses against the flange 13. In this way, the flange 13 and the disk 10 in fact form together a pair of pincers, or a clamping system, between which the wire being wound may be caught when a new bobbin is slipped on the shaft to abut the disk with the wire between disk and flange: the wire may then be released again upon retracting the disk to the right.

The disk 10 has a circumference which is so shaped as to be able to receive a number of wire loops around its circumference. This disk acts as an auxiliary spool for temporary storage for a length of wire, referred to as the wire fore-end, the function of which will be described below.

In use, when a new empty bobbin is placed on the shaft, the wire is clamped between the bobbin flange 13 and disk 10, and the shaft is started into rotation, the disk receives an initial length of wire from pulley 17.

The guiding mechanism of the apparatus comprises a guide pulley 17 as a first wire guide, and a wire pusher 18 which serve as an auxiliary wire guide. This pusher is movable between a non-operative and an operative position. In FIG. 2 the pusher has been represented in its non-operative position. It is mounted on an arm which is slidable in a tube 20 and movable to the left, to its operative position, by means, not shown in the drawings, which are well-known in the art, and which can be mechanical, pneumatic or electromagnetic.

When the pusher 18 is in its non-operative position, a wire fed to the apparatus can follow one of two paths.

The first path is the normal path over the pulley 17 to the core of the bobbin 3, between both flanges. To that end the pulley 17 is movable in an axial direction, from the left to the right and back, in order to distribute the wire equally on the core between the two flanges. The second path is used initially, when the wire fore-end is to be wound upon the disk 10. This is shown as path 19 on FIG. 1. This wire path is stable, that is to say that this wire path, once it is followed, does not by itself change over to follow the normal path, by virtue of the presence of the flange 13. To change the path, operation of the wire pusher 18 is necessary. Thus pusher is so arranged that, when moved to the left into its operative position, it pushes the wire, from its initial path from pulley 17 to disk 10, over the flange 13, into an unstable path which further jumps over to the said normal path. In other words, the pusher 18 pushes the wire over the flange 13 so that it no longer winds onto disk 10, but onto bobbin 3 between the flanges.

During the time that the wire follows the initial path towards the disk 10, and during change-over, it is preferred to maintain the pulley 17 in its extreme right position.

There are also other moments, as will be clear hereafter, when the pulley is required to move axially, but not in a simple back-and-forth movement. The pulley is therefore fixed to an arm 21 which is axially movable, in the direction of the arrows shown in FIG. 2, between an extreme left position in which it is able to lead the wire adjacent the left flange, and an extreme right position, suitable for leading the wire adjacent the right flange 13 of the bobbin. This arm 21 is linked to a position-control system not shown but well-known by those skilled in the art, which is adapted to command the position of the arm according to a fixed programme, in accordance with the different operations to be carried out.

When, during rotation of the shaft and bobbin, the pusher 18 pushes the wire over the flange so that it is no longer wound on disk 10, but on bobbin 3 between the flanges, then the configuration of the wire which is already wound up will be as follows: firstly a few loops on the circumference of disk 10, than a transitional wire portion 22 which jumps over the flange 13 (FIG. 4), and further a number of loops on the core of the empty bobbin. The few loops on the circumference of the disk are then the wire fore-end for the bobbin in rotation. The transitional portion 22 runs along the outer surface of the flange 13, then over the rim 23, and further along the inner surface of the flange towards the core of the bobbin. Whilst the bobbin is further rotating, this transitional portion will follow the rotation thereof in the sense of the arrow 24. In this way the bobbin can continue to be filled until it is full. The first loops on the core, adjacent to the transitional wire portion 22, are then well covered and fixed by the subsequent turns.

The apparatus further comprises a wire-guiding finger 25 which is shown in FIG. 2 in its non-operative position. This finger has a form similar to a question mark and is fixed to an arm which is supported in a tube 35, where this arm is movable to the left in order to bring it into an operative position. The movement of this arm is driven by means, not shown in the drawings, but which are well-known and may be mechanical, pneumatic or electromagnetic and commanded from the same control panel as mentioned before.

The operative position of the guide finger 25 is shown in more detail in FIG. 4. The finger has a sharp extremity 26 which is in slight frictional contact with the outer surface of the flange 13, and lies tangentially to the flange a small distance from the rim 23. Then the finger diverges, slightly in an axial direction away from the flange and at the same time radially away from the axis of the bobbin until it extends over the flange to a position axially inwardly thereof and then again turns towards the outer side of the flange in order to form a hook in order to hook the wire end running from the disk 10 to the inner side of the core of the bobbin. This finger 25 is made to catch, when in operative position, the transitional portion 22 of the wire, as determined hereabove, when it passes along the finger and to draw the wire fore-end, by the rotation of the bobbin, from disk 10 towards the bobbin for winding up between the flanges. This happens in the way illustrated in FIG. 4, which shows different consecutive positions of the transitional portion during the time that it is caught. During that operation the disk 10 must be retracted to its position where it does not longer clamp the wire extremity between the disk and the flange. The transitional portion firstly arrives in the position 27, and then passes over the sharp extremity 26 of the finger as shown in position 28. As it continues to rotate with flange, it comes consecutively in the positions 29 and 30, where it is lifted from the rim of the flange into position 31, to finally come to stop in the position 32, where it is caught in the hook-form of the finger, which prevents this transitional portion from continuing to follow the rotation of the flange. As the bobbin continues its rotation, the few loops of wire wound on the disk 10 are drawn off in the direction of arrow 33, slide over the hook further in the direction of arrow 34 and are then wound on the outer surface of the wire on the bobbin, between the flanges. The number of loops on the disk must thereafter be limited to the maximum possible number of loops which can be drawn off by sliding from the disk circumference without these tightening by friction around the disk and becoming locked around it.

The bobbin transport mechanism for replacement of a full bobbin by an empty one is shown in FIG. 1 in side view and a front view of a section according to the line BB is introduced in FIG. 2 for better understanding. This transport means comprises a carrier support member 40 which is fixed to a hollow tubular spindle 41. This spindle 41 is parallel with the axis of the shaft 2 and this spindle and all components that are co-axial with it have been represented in FIG. 2 in a sectional view according to line CC of FIG. 1. The spindle 41 is held in the fixed frame 1 by means of a sliding-bearing 42 in which the spindle is rotatable and axially translatable.

The transport mechanism further comprises a pair of identical bobbin carriers in the form of tables 43 and 44 which are shown in FIG. 1 in a horizontal position in which they each support a bobbin. The upper surface of these tables is so shaped as to to able to carry a bobbin, co-axial with the shaft, standing on its flanges in stable equilibrium without danger that it would roll off the table. The tables are fixed to respective tubular supports 45 and 46 which are rotatably, but non-translatably mounted on respective pivots 47 and 48 fixed in the support member 40. These tubular supports are parallel to the shaft 2 and to the spindle 41 and symmetrically disposed with respect to the spindle 41.

In order to keep the tables 43, 44 horizontal, it is necessary to ensure that the tubular supports 45, 46 maintain the same angular positions even when member 40 is rotated around the spindle 41, as shown by the circle 49 and arrow 50 which shows the path of the tubular supports during rotation of the carrier support member 40. To this end, the support spindles 45 and 46 are linked to a positioning member 51 via gearing means having toothed wheels 52 to 56. Wheels 52 and 53 are respectively part of the tubular supports 45 and 46, and are linked by respective wheels 54, 55, each of which is rotatable around a respective spindle which is fixed in the member 40, to a toothed wheel 56 which has the same number of teeth around its circumference as wheels 52 and 53, and which forms part of the positioning member 51. This member 51 is co-axial with the spindle 41 and is mounted in the hollow core of the spindle 41 in such a way as to be rotatable, but not translatable in it. Thus when the positioning member maintains its angular position so that wheel 56 is held immobile during rotation of the co-axial spindle 41, then the wheels 52 and 53 also keep their angular position and the tables remain horizontal during movement of the tubular supports 45 and 46. In other words, the tables (and thus the bobbins mounted thereon) can follow a translation according to a circular path, without rotation.

As can be seen on FIG. 1, the transport means is so designed that, in a first position, called hereafter the first coincidence-position, and represented in FIG. 1, the bobbin on table 43 is co-axial with the shaft 2. When the spindle 41 and support member 40 are rotated by a half revolution, then the bobbin on table 44 in its turn comes in coaxial relationship with the shaft which is the second coincidence-position. The tubular supports 45 and 46 are symmetrically disposed with respect to the axis of the spindle 41. By rotation through a further half-revolution in the same sense as the preceding half-revolution, the system can come back to its first coincidence-position.

When however the spindle 41 and the frame 40 are held immobile, and the positioning member 51 and toothed wheel 56 are slightly pivoted over a small angle in the sense of arrow 57, then the tables 43 and 44 will slightly rotate around pivots 47 and 48, and table 44 for instance, will take the position shown in dotted lines 58. To this end, the tables are so disposed in the transport mechanism, that the tubular supports 45 and 46 are not co-axial with the axes of the bobbins carried by the tables. In that case, a small pivoting of positioning member 51 results in table 44 pivoting from its upper position shown in FIG. 1 into a lower position 58 which still is able, by a suitable design of the surface of the table, to carry a bobbin in stable equilibrium. And at the same time, table 43 will also pivot over a same angle downwards from an upper position, shown in FIG. 1, to a lower position (not shown). This pivoting serves three purposes. First, once the bobbin 3 is supported by the shaft, table 43 must be removed from contact with the bobbin in order to enable the latter to rotate freely. Second, it brings table 44 in contact with ground level, so that replacement of a bobbin on this table can be achieved by rolling the bobbins from the floor on and off the table. Third, it serves as wire breaking mechanism for breaking the wire as will be explained hereinafter.

When a bobbin is full, this bobbin is translated by the transport mechanism from its working position, as bobbin 3 is shown in FIG. 1, into a rest or stand-by position, as bobbin 59 is shown in FIG. 1. The sequence of movements of the transport mechanism is such that, when the full bobbin comes into the position of bobbin 59 and a new bobbin is slipped over shaft 2, the wire which comes from pulley 17 (FIG. 2), is clamped between flange 13 and disk 10, which forms a clamping system as described above, and then extends from this clamping system to the full bobbin 59. When in this situation both tables are pivoted downwards, bobbins 3 remains unmoved, supported by shaft 2, whereas bobbin 59 goes downwards. As a result, the wire between said clamping system and the bobbin in its rest position comes under tension and breaks.

The positioning member 51 is further, along a part of its length, provided with a screw-threaded hollow core in which engages a complementary threaded screw 60 rotatably held in the fixed frame 1. This screw 60 can be rotated via a belt on a wheel 61, by driving means not shown. When the screw is rotated in one sense, the positioning member 51 receives a translation from its extreme right position as shown in FIG. 2, towards the left. Because this member 51 is mounted in a non axially movable way in the tubular spindle 41, the spindle then also moves to the left, and with it the whole carrier support member 40, tubular supports, tables 43 and 44 and the bobbins also move to the left. This movement is only possible when the door 7 is open and during that movement, the bobbin 3, when it rests on its table and is not longer supported by the shaft, will be slipped off the shaft into an extreme left position where the core of the bobbin is completely clear of the shaft 2. The length of the screw 60 must thus be at least equal to the distance between the bobbin flanges, to which is added the length by which the shaft protrudes to the left out of the hollow core of the bobbin 3 in its working position.

Care must however be taken for arranging that the spindle 41 and positioning member 51 keep their position during this axial translation. As will be explained later, rotation of the spindle 41 is only desired when the transport system is in the extreme left axial position, and rotation of the positioning member 51 is only desired when the transport system is in the extreme right axial position, as it is shown in FIG. 2. To this end, the spindle 41 and positioning member 51 are each provided with a co-axial toothed wheel, respectively 62 and 63, adjacent to each other, and having the same diameter. The apparatus further comprises an axially extending fixed tooth 64, shown in side view in FIG. 2*a* which allows free axial movement of wheels 62 and 63, and which engages with the teeth of wheels 62 and 63, in order to prevent their rotation, in any axial position, except for wheel 62 in the extreme left position (as shown in interrupted line) and for wheel 63 in the extreme right position of both wheels. In the said extreme left position, wheel 62 is then made to engage (as shown in interrupted line) with a toothed wheel 65 which is driven by a control motor, not shown, which then controls the position and the rotation of the spindle 41. In the extreme right position, wheel 63 is made to engage with a toothed wheel 66 which is also driven by a control motor, not shown, which commands the position and rotation of the positioning member 51. Both control motors are connected to the abovementioned control panel for receiving the necessary control signals to start and stop rotation, in a manner well known in the art.

Figures 3B, 3C, 3E, 3F:
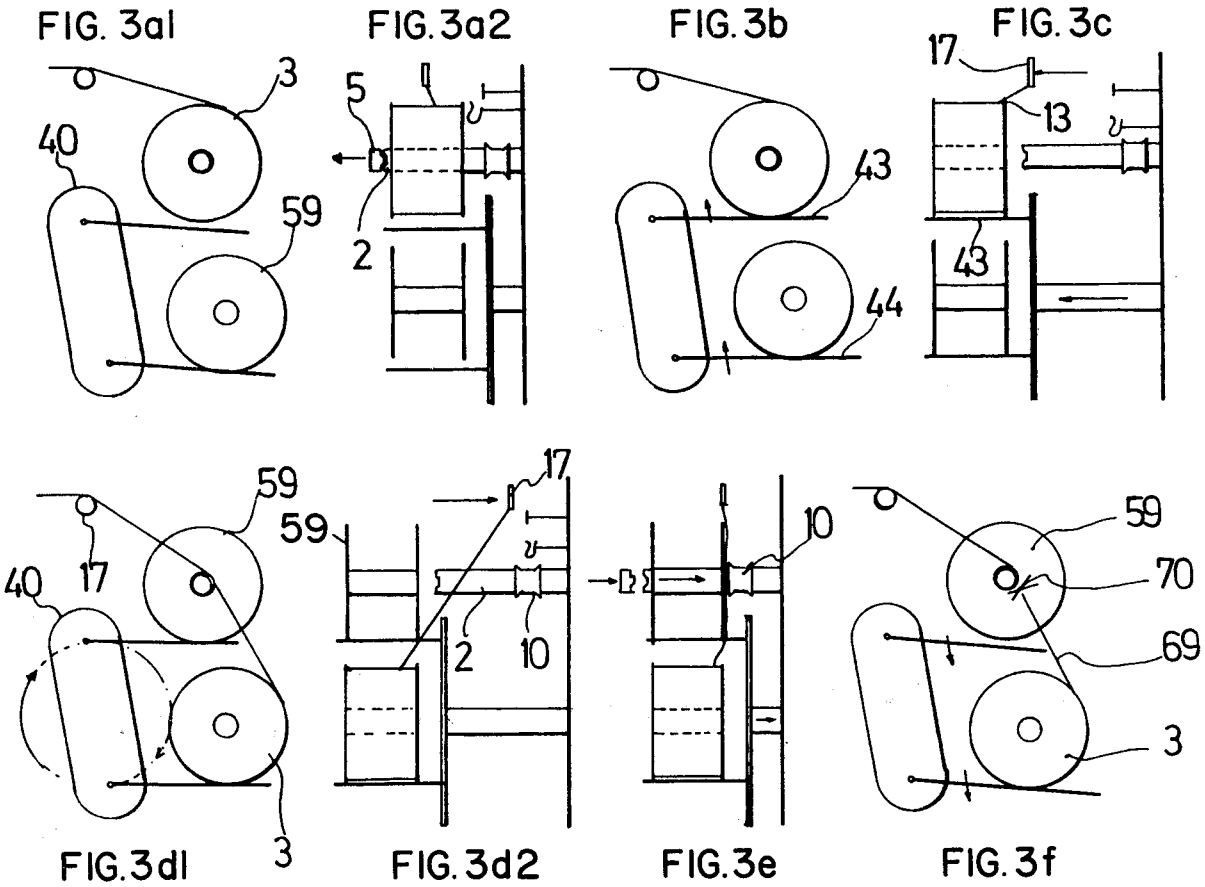
Figures 3G, 3H, 3I, 3J:
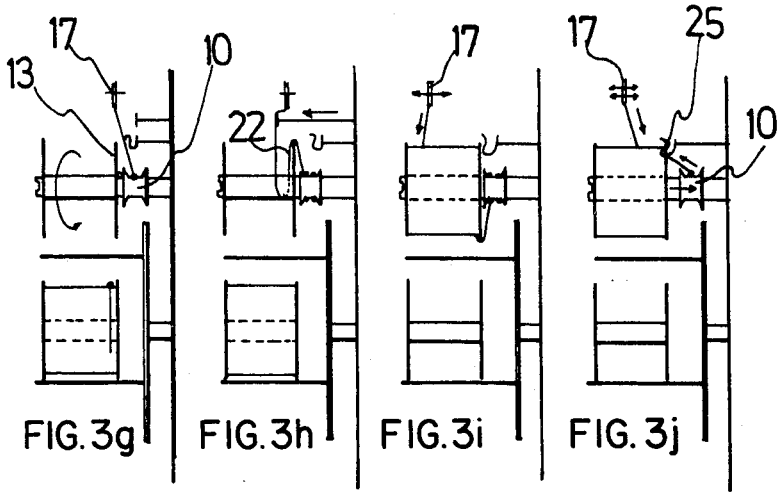

In operation, the apparatus works as shown in the consecutive positions schematically represented in FIG. 3 *a*1 to *j*. FIGS. 3*a*1 and 3*d*1 are side views and FIGS. 3*a*2 and 3*d*2 are front views. FIGS. 3*b* and 3*f* are side views and FIGS. 3*c*, 3*e* and 3*g* to *j* are front views.

In FIG. 3*a*1, the apparatus is shown in its position when the bobbin 3 in its working position on the shaft is fully wound with wire and just after having stopped rotation of the shaft. The carrier support member 40 of the bobbin transport mechanism is then in its first coincidence position in which the axis of the first bobbin coincides with the axis of the bobbin shaft. The second bobbin 59 rests on its flanges on the surface of its corresponding support table and is an empty bobbin which has been rolled thereon by the operator of the apparatus. As shown in FIG. 3*a*2, the first operation is to remove the centre 5 from the extremity of the shaft at the left-hand side, where the full bobbin will have to be removed. When this centre is mounted on a door, this operation corresponds with unbolting and opening the door. Before opening the door, the centre can firstly be given a small axial translation, by a suitable mechanism mounted in the door and hydraulically driven, away from the shaft.

At the same time or subsequently, the support-tables 43 and 44 are pivoted upwards to their upper position (FIG. 3*b*), until table 43 gives support to the full bobbin, and then the radially extending keys on the bobbin shaft are moved inwards into the shaft, so that they no longer engage the inside of the hollow core of the full bobbin and that the shaft loses its grip on the bobbin which is then completely supported by the table 43.

Then the translation mechanism of the bobbin transport mechanism is put into operation to translate the whole transport mechanism from its initial extreme right position of FIG. 3*a*2 into its extreme left position of FIG. 3*c*. During that movement, the full bobbin, supported by its table 43, is slipped off the shaft 2 in an axial direction. Preferably, the programme for the axial movement of the wire-guiding pulley 17 is so programmed in order to bring it into a position just to the right of flange 13, as shown in FIG. 3*c*. This ensures that the wire from the pulley to the bobbin is not pulled over the flange 13.

Subsequently, the support member 40 is rotated through a half revolution in the sense of the arrow (FIG. 3*d*1) into its second coincidence position in order to exchange the positions of the full and the empty bobbin. At the same time, the pulley 17 is gradually moved towards its extreme right position (FIG. 3*d*2). Both movements are so combined that the wire coming from pulley 17 comes to lie over the unloaded shaft 2, between the left extremity where the empty bobbin will have to be slipped on, and the disk 10, which will act as an auxiliary spool.

At this moment the apparatus is ready for loading the bobbin shaft with the new empty bobbin 59. The translation mechanism of the bobbin-transport mechanism is put into operation to translate the whole transport mechanism from its extreme left position back into the extreme right position (FIG. 3*e*). The wire, coming from pulley 17 and running over shaft 2 towards the full bobbin 3 is then clamped between the outer surface of the flange of the new bobbin and the disk 10.

The door of the housing is closed again and bolted, whilst the centre 5 is again applied to the extremity of the shaft (FIG. 3*e*) to support that extremity for rotation, and the keys on the shaft are moved outwardly of the shaft in order to engage the inner surface of the core of the bobbin. At the same time or subsequently, the support tables are pivoted downwards back to their lower position (FIG. 3*f*). The empty bobbin keeps its position because it is supported by the shaft, but the full bobbin 3, supported by its support table moves downwards. Since the wire is clamped between the flange of empty bobbin 59 and disk 10, the wire end 69 between the full bobbin and the place where it is clamped comes under tension and breaks under the weight of the full bobbin as shown by the cross 70 or FIG. 3*f*. This is specially suitable in systems where soft copper wire is wound up. The higher the diameter of the wire, the heavier the full bobbin must be, but this is generally so, because for wire of greater diameter, bobbins of accordingly higher flange diameter must be used in order to keep a same economically justified winding-up time per bobbin. For copper wire of e.g. max 0.6 mm diameter, bobbins for winding-up 125 kg of wire will be sufficient.

Then (FIG. 3*g*), the bobbin shaft is put into rotation and, together with the shaft, the bobbin 3 and disk 10 rotate. The wire, coming from pulley 17, then follows a path along the outer side of the flange 13 and, as its extremity is clamped, it is wound for a few turns on the circumference of disk 10, which acts as an auxiliary spool. After these few turns, the auxiliary wire guide or pusher 18, which up to now has still been in its non-operative position jumps to the left (FIG. 3*h*) into its operative position and pushes the wire over the flange so that the wire coming from pulley 17 from now on, after pusher 18 has moved again to the right into its non-operative position, is wound on the core of the bobbin, and so as to form a transitional wire part 22 which jumps over the flange and which now rotates together with the flange during further winding-up until the bobbin full. During that time, guide pulley 17 is made to travel axially back and forth over the flange width in order to provide an equal distribution of the wire between the flanges (FIG. 3*a*). During that time, the operator can replace the full bobbin in its stand-by position by an empty one, Once the bobbin is full, the wire guiding finger 25 which up to now has still been in its non-operative position, is moved to the left into its operative position until its extremity comes into frictional contact with the bobbin (FIG. 3*j*). And at the same time, the disk 10 is moved to the right, releasing the wire extremity which was clamped between the disk and the outer surface of the flange. As explained with the help of FIG. 4, the result is that the wire fore-end, wound on disk 10, is drawn off from that disk and wound on the exterior surface of the wire wound on the bobbin, near the right flange. The movement of the guide pulley 17 is then so programmed to lay the final part of the trailing end of the wire as a small number of windings with a high pitch. At this moment the rotation of the shaft is stopped and the apparatus comes into its initial position of FIG. 3*a*.

As the bobbins can be rather heavy, it is desirable, when they are full, that they are firstly run down to lower winding speed before the actions shown in FIG. 3*j* are started. For automatic control, the apparatus will therefore be provided with a detector or proximity-switch, adapted to provide a signal to the driving mechanism of the shaft for commanding run-out of the shaft. The apparatus will further be provided with a detector of the rotational speed of the shaft, adapted to detect the moment when the speed drops below a given reference and to deliver a response to the driving means for the finger 25, disk 10 and pulley 17 to start their axial movement as shown in FIG. 3*j*.

It is clear that the apparatus as described hereabove is only an embodiment of the invention given by way of example. The same invention can however be realized in many other forms for which also protection is claimed.

What I claim is:

1. A winding-up apparatus comprising a shaft, arranged for extending through the core of a bobbin, rotatable mounted at one end of the shaft and arranged for reception and removal of said bobbin, via the other end by translation of said bobbin in axial direction, the apparatus comprising:

(a) a carrier support member having first and second bobbin carriers mounted thereon, the carrier support member being rotatable about an axis parallel to that of the bobbin shaft between first and second coincidence positions in which bobbins mounted on the first and second bobbin carriers respectively can be located coaxially with the bobbin shaft, the bobbin carriers being rotatably mounted on the carrier support member for rotation about axes parallel to, but offset from both the axis of the carrier support member and the core of a respective bobbin when mounted thereon;

(b) a positioning member, pivotable around an axis parallel to that of the bottom shaft, and linked by a transmission system to said bobbin carriers in order to have the latter to follow the angular position thereof, whereby pivoting the positioning member causes pivoting of each bobbin carrier between an upper position for locating a bobbin carried thereon coaxially with the bobbin shaft, and a lower position;

(c) and a translation mechanism for axial movement of the bobbin carriers relative to the bobbin shaft whereby a bobbin mounted on a carrier in its coincidence and upper position may be moved axially from a position in which the bobbin core is substantially traversed by said shaft for removing said bobbin from said shaft.

2. A winding apparatus according to claim 1 in which said translation mechanism is connected to said carrier support member for translation of the support member with the bobbin carriers mounted thereon.

3. A winding apparatus according to claim 2, in which the axes of rotation of the bobbin carriers are symmetrically disposed on the carrier support member, whereby movement of the carrier support member from its first to its second coincidence position, and further from its second into first coincidence position, is achieved by an 180° rotation of the carrier support member, and further by another 180° rotation in the same sense.

4. A winding apparatus according to claim 3, in which the axis of pivoting of said positioning member and the axis of rotation of said carrier support member are coaxial, and said transmission system to said bobbin carriers is a planetary system comprising a number of toothed wheels.

5. A winding apparatus according to claim 4, in which the carrier support member is mounted on a tubular support shaft for rotation therewith, and in which the positioning member is a further shaft located and non-translatably mounted within the support shaft, and the translation mechanism comprises a said further shaft.

6. A winding apparatus according to claim 5 in which each bobbin carrier comprises a substantially horizontal table of which the surface is so shaped as to keep a bobbin, standing on circular flanges, in a stable equilibrium on the table in both upper and lower position and during transition from the one to the other.

7. A winding apparatus according to claim 5 which includes a centre, movable between an operative position in which is engages under axial pressure the free said other end of the shaft, and a retracted position enabling a bobbin to be received on and removed from the bobbin shaft.

8. A winding apparatus according to claim 7, wherein the said centre is mounted in a door which, in the operative position of the centre, closes a housing for the bobbin, and in the retracted position of the centre, is open to enable a bobbin to be introduced into and removed from the said housing.

9. A winding apparatus according to claim 5 wherein the bobbin shaft is provided with axially extending keys which are movable radially out of the shaft to engage the inside of a hollow cylindrical core of a bobbin over substantially its entire length.

* * * * *